US007316643B2

(12) United States Patent
Makar et al.

(10) Patent No.: US 7,316,643 B2
(45) Date of Patent: Jan. 8, 2008

(54) CARTON FLAP GRIPPING SYSTEM

(75) Inventors: Chris Peter Makar, Vancouver (CA); Peter Clive Sewell, Vancouver (CA)

(73) Assignee: Wexxar Packaging, Inc., Delta, British Columbia (CA)

( * ) Notice: Subject to any disclaimer, the term of this patent is extended or adjusted under 35 U.S.C. 154(b) by 0 days.

(21) Appl. No.: 11/674,694

(22) Filed: Feb. 14, 2007

(65) Prior Publication Data

US 2007/0128898 A1 Jun. 7, 2007

Related U.S. Application Data

(62) Division of application No. 10/981,581, filed on Nov. 5, 2004, now Pat. No. 7,192,393.

(51) Int. Cl.
*B31B 1/78* (2006.01)
*B65B 43/68* (2006.01)

(52) U.S. Cl. ..... 493/309; 493/478; 53/382.1

(58) Field of Classification Search ..... 53/381.1, 53/382.1, 564; 493/183, 309, 310, 478
See application file for complete search history.

(56) References Cited

U.S. PATENT DOCUMENTS

| | | | | | |
|---|---|---|---|---|---|
| 3,220,159 | A * | 11/1965 | Killeen | 493/309 |
| 3,695,151 | A * | 10/1972 | Caron | 493/181 |
| 4,348,853 | A * | 9/1982 | Morse et al. | 53/381.1 |
| 4,553,954 | A * | 11/1985 | Sewell et al. | 493/309 |
| 6,080,095 | A * | 6/2000 | Chen | 493/309 |
| 6,669,616 | B1 * | 12/2003 | Bierenacki et al. | 493/309 |
| 7,131,941 | B2 * | 11/2006 | Makar et al. | 493/309 |
| 7,192,393 | B2 * | 3/2007 | Makar et al. | 493/309 |

* cited by examiner

*Primary Examiner*—Louis Huynh
(74) *Attorney, Agent, or Firm*—Thompson Hine LLP

(57) ABSTRACT

A gripping system uses a pin mounting block having at least one passage for accommodating holding pins of a holding pin member that cooperate with a dome to hold a laminate ply there between, the improvement being a releasable latch positioned to engage the pin member and hold the pin member in an operative positions and being releasable to release the pin member. Various forms of pin members may be used. In a preferred form, a gripper is provided positioned adjacent to holding pins and moveable between a retracted position and an operative position wherein the gripper member grips the laminate ply.

11 Claims, 5 Drawing Sheets

CARTON FLAP GRIPPING SYSTEM

REFERENCE TO RELATED APPLICATIONS

This application is a division of and claims priority to U.S. patent application Ser. No. 10/981,581, filed Nov. 5, 2004, now issued as U.S. Pat. No. 7,192,393.

FIELD OF INVENTION

The present invention relate to a flap gripper for a case erector, more particularly to a quick and simple pin changing system for a pin type gripper.

BACKGROUND OF THE PRESENT INVENTION

Pin type grippers that employ a combination of substantially straight pins and cooperating domes have been used successfully in case opening systems for corrugated boxes many years. Corrugated boxes are boxes generally make from corrugated board composed of a pair of outer liner with a corrugated medium there between. The corrugated medium connects and holds the liners in substantially parallel spaced relationship. These pin type gripper systems rely on a series of pins that are carefully aligned with domes and that penetrate the open end of panels (flaps) on the corrugated box (i.e. between the liners) in a direction parallel to the longitudinal axis of the corrugations in the medium. The pins combine with their respective adjacent domes to grip the liner there between.

Attention is directed to U.S. Pat. No. 4,553,954 issued Nov. 19, 1985 Sewell et al. which shows a known pin and dome systems and applies it in known manner to grip adjacent panels of a corrugated box and then move them to squared position i.e. at right angles to each other to in effect open the case as part of the case erection process.

One of the major complains about these known systems that has subsisted over the years is the difficulty in adjusting the grippers to accommodate different type of corrugated material from which the boxes may be made. These adjustments are currently achieved in two different ways namely by adjusting the clearance between the pins and their respective adjacent domes or by adding or subtracting to change the total number of pins being employed.

Adjusting the clearance is obtained by removing the pin blocks which are formed with the longitudinal axis of the pins closed to one mounting surface than the opposite mounting surface and flipping the pin blocks and reattaching them so that the position (spacing) of the pins from the surface on which the pins and domes are mounted is changed. In the known systems this is a time consuming process in that it requires the use of tools to remove the pin blocks and requires time to ensure that when the blocks are reassembled in the apparatus they are correctly aligned Changing the number of pins for reducing the number of pins requires removal of the set screws that hold each individual pin to be removed in its mounting block and removing the pin. Increasing the number of pins requires positioning the additional pin(s) and inserting and tightening the clamping set screw to clamp the added pin in position. If a set screw was already in place it must at least be loosened the pin inserted and then tightened so that the set screw holds the new pin in place.

Even when the pins are properly inserted there are occasions where slippage is incurred which on occasion results in the case moving relative to the jaws during the squaring operation

BRIEF DESCRIPTION OF THE PRESENT INVENTION

It is an object of the present invention to provide a relatively easily and quickly adjustable pin and dome gripping system for corrugated box case erectors to facilitate handling of boxes made of different corrugated material.

It is a further object of the present invention to provide a supplemental gripping system for better locking the case to the jaws during the squaring operation Broadly the present invention relates to a gripping system for equipment for handling panels formed by laminates having at least one surface ply, said gripper system comprising a pin mounting block on an operating panel of said equipment, said block having a front face and a rear face, at least one passage through said block, said passage having a longitudinal axis substantially parallel to and spaced from an adjacent face of said operating panel of said equipment and extending from said front face to said rear face, a pin member, said pin member including a holding pin having a free end and a base end, said base end having an abutment element, a releasable latching means, said releasable latching means having a latch positioned to engage said abutment element when said pin member is in an operative positions with said free end projecting beyond said front face of said mounting block and a front face of said abutment element in contact with said rear face of the said mounting block, said releasable latching means being moveable to releasably hold said abutment element in contact with said block, a dome positioned relative to said mounting block so that when said pin member is in operative position with said free end adjacent to said domes said holding pin adjacent to said free end can cooperate with said dome to grip said surface ply there between.

Preferably said releasable latching means engages a rear surface of said abutment element remote from said free end when said pin member is in said operative position. Preferably said gripping system further includes a releasable stop means positioned relative to said mounting block to engage a rear surface of said abutment element remote from said free end when said pin member is in a retracted position with said holding pin in said passage and said abutment member spaced from said rear face of said mounting block and said free end is not in position to cooperate with said dome to grip said surface ply.

Preferably said releasable latching means and said stop means are positioned so that said releasable latching means cooperates with said pin member to hold said pin member in said retracted position Preferably said releasable latching means cooperates with a said front face of said abutment element.

Preferably, said mounting block has two said passages, said passages being substantially parallel to each other and positioned substantially the same distance from said surface of said operating panel of said equipment, and wherein said pin member includes a second holding pin parallel to said holding pin, said second holding pin having a free end similar to said free end of said holding pin and wherein said abutment means is a bridging member that interconnects said holding pin and said second holding pin to provide a substantially U-shaped pin member.

Preferably said free end of said holding pin is formed so that when mounted with one side of the holding pin adjacent to said dome the spacing between said dome and the adjacent surface of said arm is less than when an opposite side of said arms opposite said one side is closer to said dome.

Preferably said free end is pointed and said point is offset from an axial centerline of said holding pin toward one side of said holding pin so that when mounted with said one side of the holding pin adjacent to said dome the spacing between said dome and the adjacent surface of said arm is less than when an opposite side of said holding pin opposite said one side is closer to said dome.

Preferably one of said holding pins is shorter than the other and the free end of said one holding pin is too short to cooperate with said dome and grip said one of said surface layers there between.

Preferably said gripping system further comprises a gripper said gripper comprising a moveable gripper member positioned adjacent to said holding pins and moveable between a retracted position and an operative position wherein said gripper member grips said laminate.

Broadly the present invention relates to a gripping system for equipment for handling panels formed by laminates having at least one surface ply, said gripping system comprising a pin mounting block on an operating panel of said equipment, a pin member having a holding pin that terminates in a free end, a dome positioned relative to said mounting block so that when said pin member is in operative position with said free end adjacent to said dome said holding pin adjacent to said free end can cooperate with said dome to grip said surface ply there between, moveable gripper means positioned adjacent to said holding pin when said pin member is in said operative position, said gripper means having a gripping element, and means for moving said gripping element between a gripping position impairing relative movement between a laminated being gripped and said operating panel and a release position.

Preferably said gripper element is said dome and wherein said means for moving moves said dome toward said holding pin when said gripping element is moved to said gripping position.

Preferably said gripper element comprises an impaling pin having a longitudinal axis traversing said panel and wherein said means for moving moves said impaling pin axially toward said holding pin when said gripping element is moved to said gripping position.

Preferably said impaling pin impales said surface ply when said gripping element is in said gripping position.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which;

FIGS. 2 and 3 are views showing how the prior art and the present invention operate to grip the panel of a box or the like.

DETAILED DESCRIPTION OF THE INVENTION

Figure 1:
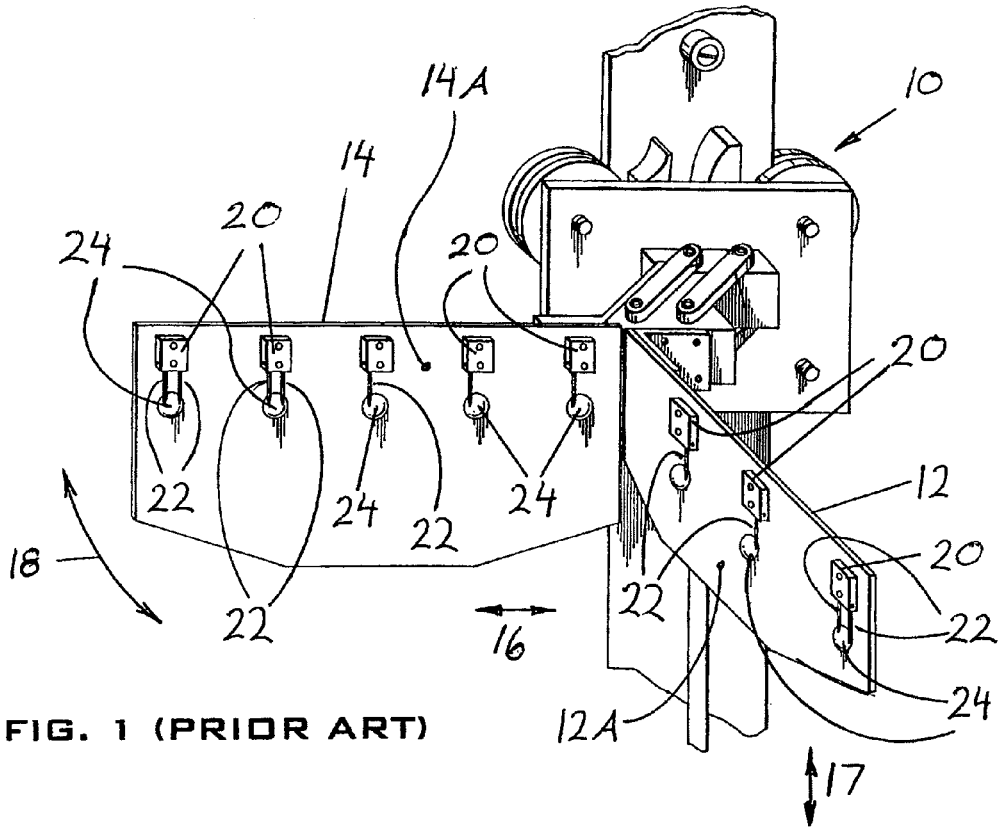
FIG. 1 (PRIOR ART)
FIG. 1 is an isometric view showing the prior art device upon which the present invention is a significant improvement with the operating panels in squaring position.

The prior art device shown in FIG. 1 is described in full in U.S. Pat. No. 4,553,954 which may be referred to for any further details of the preferred environment or application of the present invention.

As shown the device 10 comprises a pair of hinged operating panels or jaws 12 and 14 which as indicated by the arrow 16 are moveable from a receiving or pick-up position where they pick up a knocked down blank to an advanced position directly over a bottom flap folding station into which the squared blank is lowered as indicated by the arrow 17 to fold the bottom flaps.

The jaw or operating panel 14 in this device is pivoted as indicated by the arrow 18 respective to the jaw 12 between the open squaring position shown in FIG. 1 and a spaced but substantially parallel receiving position wherein the jaw 14 is substantially parallel to the jaw 12.

Figure 2:
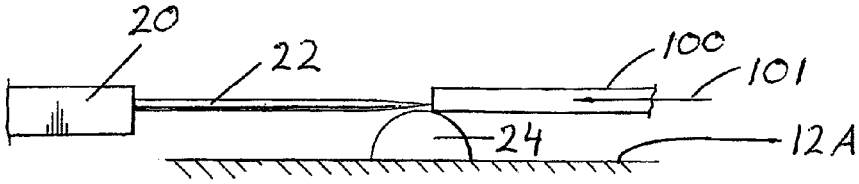
FIG. 2 (PRIOR ART)

The knocked down blanks 100 (only a portion shown—see FIGS. 2 and 3) formed of interconnected panels and flaps that are made of laminate (in the illustration are made form corrugated cardboard) composed of an outer layer 102 and an inner layer 104 generally called liners and an intermediate layer interconnecting the layers 102 and 104 that is generally in the form of a corrugated medium 105. When the jaws 12 and 14 are in the parallel receiving position (not shown) the blanks 100 are moved into a gripping position as indicated by the arrow 101 and gripped by the grippers 20 some of which are shown with a single gripping pin 22 and others with a pair of gripping pins 22.

Figure 3:
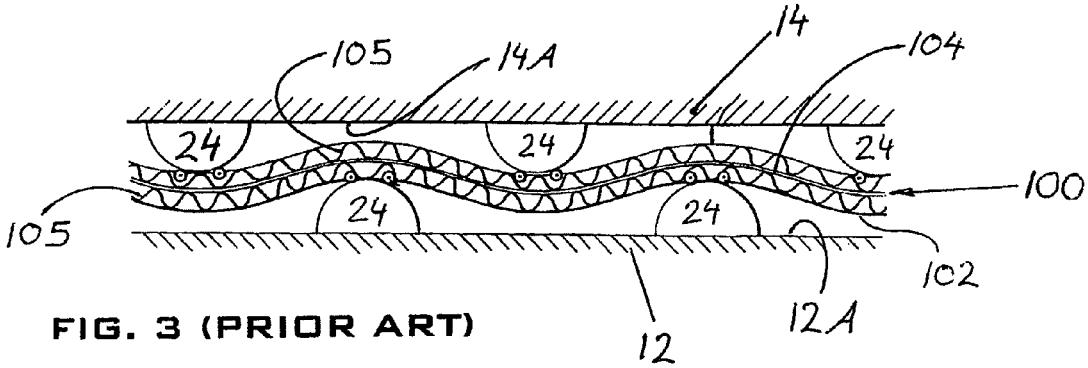
FIG. 3 (PRIOR ART)

Each gripper 20 is mounted on its jaw or operating panel 12 or 14 with its gripping pins substantially parallel to the surface 12A or 14A of the operating panels 12 or 14 and are positioned to cooperate with dome shaped projections 24 extending from the surface 12A or 14A to grip the adjacent surface layer (i.e., the outer layer 102) on opposite sides of the blank 100 in FIG. 3 by holding the layers 102 between the dome and its adjacent gripping pin to hold the flaps close to their adjacent jaw 12 or 14.

In operation as the blank 100 is moved as indicated by the arrow 101 and the pins 22 pass inside the panel immediately adjacent to the adjacent surface panel (outside panel 102)

while the panels are being deformed by the domes 24 to an undulating shape in the illustration in FIG. 3 substantially sinusoidal shape which facilitates entry of the pins 22. In order to change or reposition the pins 22 of a given gripper 20, each discrete pin must be removed from the gripper 20 and a new one mounted, which required undoing the mounting screws, taking out the pin, inserting a new one and the tightening the screws, which was very time consuming and tedious works reducing the output of the equipment.

One of the embodiments of this invention operates essentially as described above, however the improved gripping systems of the present invention significantly improves the operation of the system and overcomes problems that have been plaguing users for about 20 years.

Turning now to FIGS. 4 through 10 the gripping device 30 of the present invention is mounted on the operating panels 32 equivalent to panel 12 or 14 (only 1 shown, but to perform the box squaring operation described above panels equivalent to 12 and 14 described above will be used and the grippers 30 mounted thereon in essentially the same positions as the grippers 20 described above.

Each gripper 30 is composed of a mounting block 34 mounted to the face 32A of the panel 32 by a suitable means such as screws 36. Each mounting block 34 is provided with at least one passage which is substantially parallel to the surface 32A (see FIG. 7). In the embodiment illustrated in FIGS. 4-10 a two pin system is disclosed and the mounting block 34 is provided with two parallel passages 38 and 40 through which the holding pins 42 and 44 respectively of the pin member 46 (see FIGS. 8 and 9) pass.

Each pin member 46 is substantially U-shaped and is formed by a pair of parallel arms which form the substantially parallel gripping pins 42 and 44 and are interconnected at their base ends by an abutment member 48 which also forms a bridging connector 48 in the form of a yoke coupling the two gripping pins 42 and 44 together at their base ends. The abutment member 48 is formed to be easily grasped by an operator to remove invert and replace a pin member and to cooperate with a releasable latching element 60 to be described below to hold the pin member in operative or retracted position as will be described below.

Figure 8:
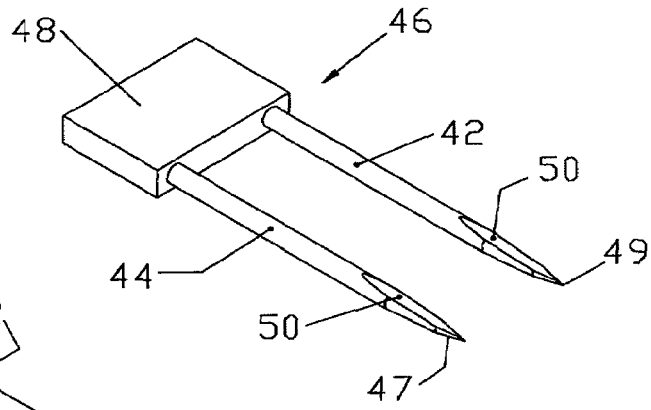
FIG. 8 is an isometric view of a U-shaped pin member for use in one embodiment of the present invention.

Each of the gripping pins 42 and 44 in the FIG. 8 embodiment are pointed as indicated at 49 and have one side ground off or otherwise removed as shown at 50 so that when in operation position with the ground off side (opposite side) adjacent to the dome 52 (see FIG. 4, 5 or 6 which is similar to the dome 24 described above with respect to the prior art) the clearance between the dome 52 and the pin element 42 or 44 is increased compared to when the member 46 is inverted so that the side which has not been ground off is adjacent to the dome 52.

Figure 9:
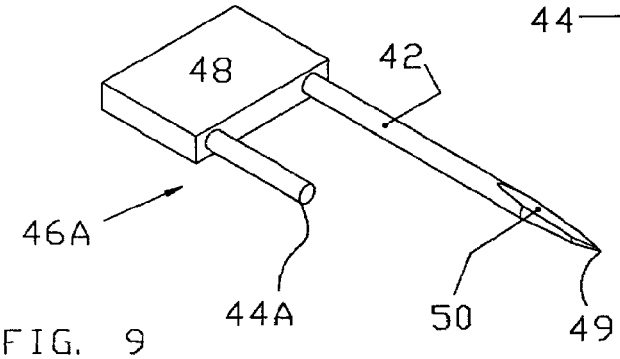
FIG. 9 is an isometric view similar to FIG. 8 of a modified U-shaped pin member constructed according to the present invention.

FIG. 9 shows a modified version of the pin member as indicated at 46A. In this version one of the pin elements 44A has been shortened so that it does not extend far enough to cooperate with the dome 52 and thus functions in a manner similar to that discussed above with respect to the prior art when one of the pins is removed as may be required depending on the material being handled.

Figure 10:
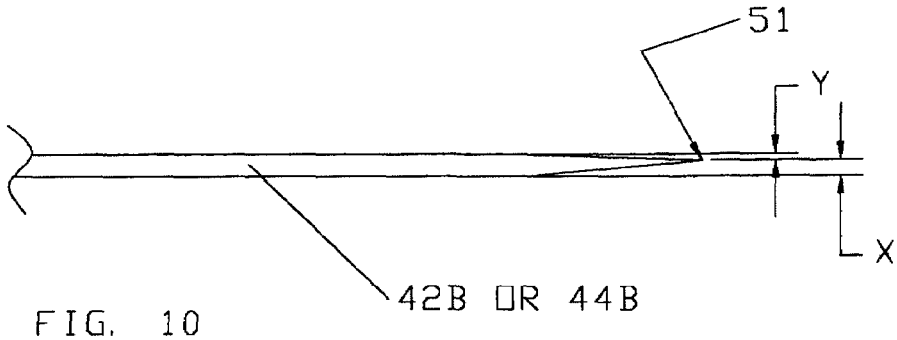
FIG. 10 is an elevation view of the free end of a modified holding pin for use in the present invention.

In an alternate arrangement as shown in FIG. 10 instead of a portion 50 being ground off as in FIGS. 8 and 9 the free end 49A of the gripping pins (42B or 44B) has been shaped with the point or tip 51 displaced toward one side of the pin i.e. the distance x from one side of the pin 42B or 44B is greater than the distance y from the opposite side of the pin 42B or 44B.

Figure 6:
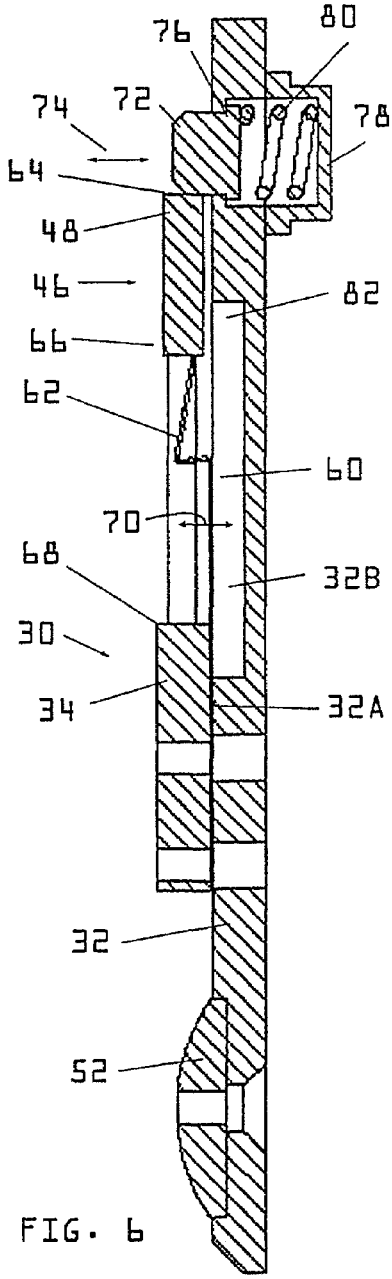
FIG. 6 is a section along the line 6-6 of FIG. 5.
Figure 7:
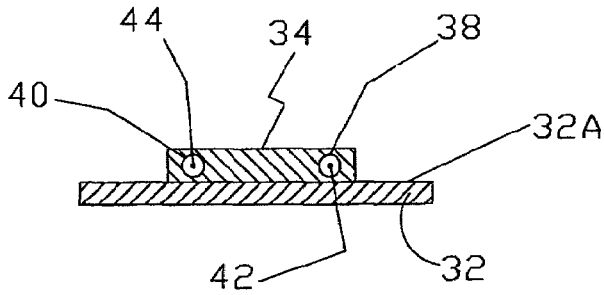
FIG. 7 is a section along the line 7-7 of FIG. 5.

Also mounted on the panel 32 is a spring latching element 60 that has a latching or abutment section 62 at one end thereof and a substantially flat spring element extending there from and terminating between the mounting block 34 and the panel 32 and is held in place preferably by the screws or the like 36 (see FIG. 6). In the illustrated arrangement the latching or abutment section 62 is adapted to bear against the back 64 of the abutment member (bridging connector) 48 of the pin member 46 and hold the front face 66 of the abutment member 48 against a rear surface 68 and thereby the member 46 in extended operative position with the free end(s) 49 of the holding pin(s) 42 (and/or 44) in operative position to cooperate with the dome 52 and grip the laminate layer 102 there between. The distance between the rear surface 64 and front face 66 of the abutment member 48 is coordinated with the position of the section 62 so that the latch 60 holds the member 46 in position as above described.

The section 62 may be released by pushing down on the latch 60 and bending the flat spring section 64 to move the section 62 as indicated by the arrow 70 (see FIG. 6) into the groove 32B formed in the panel or jaw 32 adapted to receive the latch member 60. To the rear of the pin member 46 (side of the pin member 46 remote from the mounting block 34) a moveable stop button 72 which is mounted on the panel or jaw 32 in a manner to permit it to be depressed to release the pin member and permit it to be withdrawn from the holding block 34 and inverted as desired.

Figure 4:
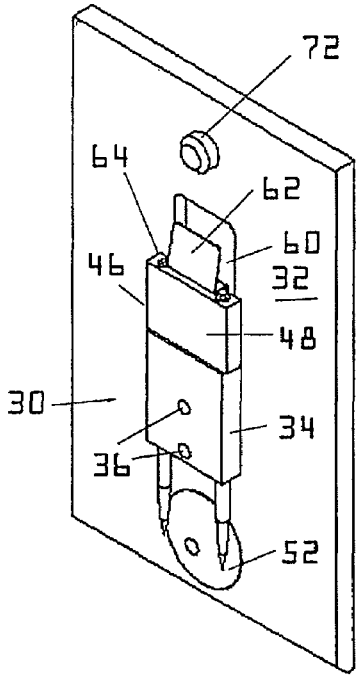
FIG. 4 is an isometric view showing one embodiment of the pin mounting system of the present invention showing the pin member in operative position.
Figure 5:
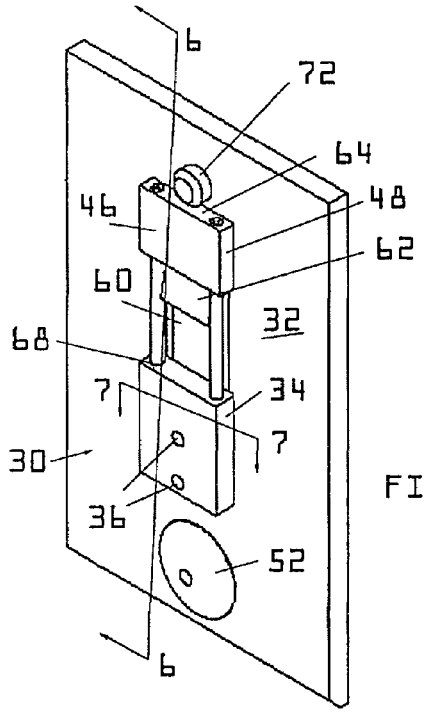
FIG. 5 is an isometric view showing the pin mounting system of FIG. 4 with the pin member in retracted position.

In the illustrated arrangement the end 76 of the button 72 is trapped in a pocket 78 formed in the panel or jaw 32 and is biased to the extended position shown in FIGS. 4, 5 and 6 by a suitable spring 80 or the like.

In some instances it may be desired to simply retain the member 46 in inoperative position retaining or retracted position as shown in FIGS. 5 and 6 without removing it from the jaw 32. To accommodate this the stop button 72 is positioned relative to the rear retaining portion 82 of the latch 62 so that when the member 46 is in the retaining position illustrated the rear end 64 of the abutment 48 bears against the stop button 72 and the front face 66 of the abutment 48 is engaged with the portion 82 of the latch 62.

It will be evident that to permit the portion 82 to fully cooperate with the face 66 it does so between the holding pins 42 and 44 and thus the latch 60 (at least the latching member 62) will preferably be dimensioned to fit between the pins 42 and 44.

Figure 11:
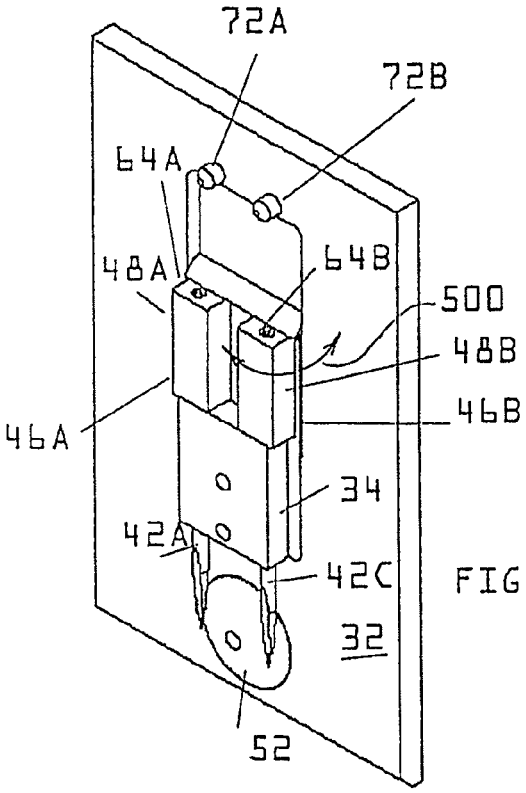
FIG. 11 is an isometric view similar to FIG. 4 but showing a modified form of the invention with the pin members in operative position.
Figure 12:
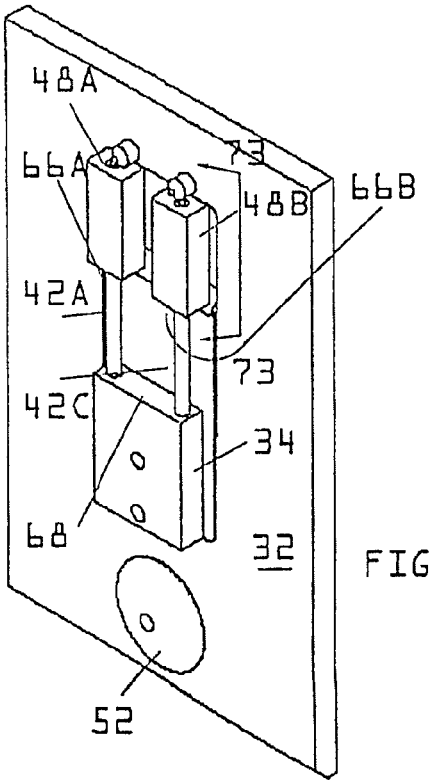
FIG. 12 is an isometric view similar to FIG. 5 showing the modified form of the invention illustrated in FIG. 1 with the pin members in retracted position.
Figure 13:
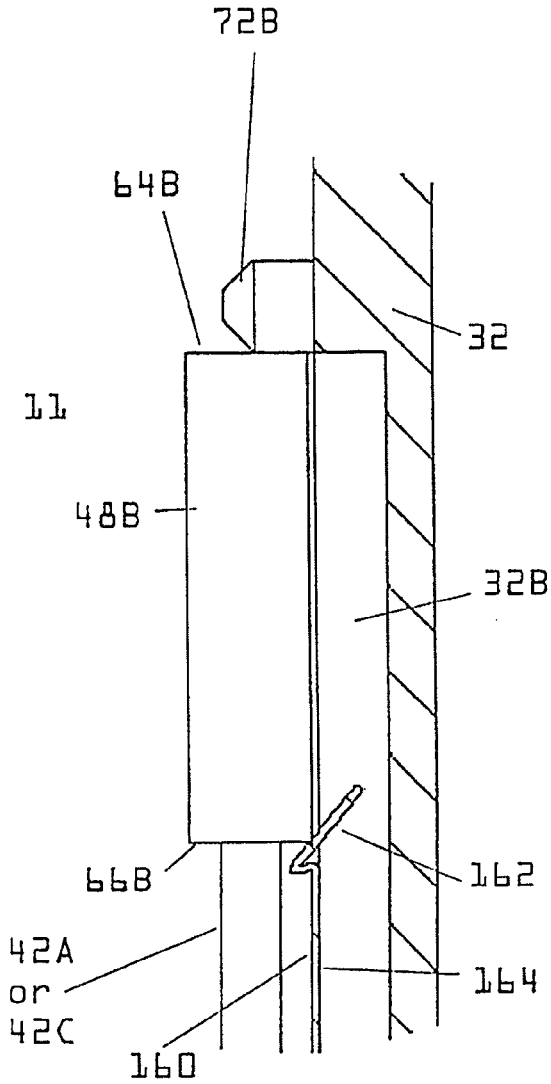
FIG. 13 is a section on the line 13-13 of FIG. 12.

Turning now to FIG. 11, 12 and 13 the embodiment illustrated here is similar to the embodiment of FIGS. 4 to 10 except that in the FIG. 11 to 13 embodiment the in effect double or twin gripping pin members 46 employing a single abutment member 48 interconnecting the pins 42 and 44 of FIGS. 4 to 10 inclusive have been replaced a pair of discrete single pin members 46A and 46B each having its respective abutment member 48A or 48B so that each pin member has a single gripping pin 42A or 42C that corresponds with the pins 42, 44, 44A, 44B or 42B (shown in FIGS. 8, 9 and 10) as shown in FIG. 11 and 12. Each member 46A and 46B is provided with its moveable stop 72A or 72B and rear faces 64A and 64B respectively that cooperate with their stop 72A or 72B when in retracted position (FIG. 12) in the same manner as the rear face 64 cooperates with the stop 72 as described above and when in operative position (FIG. 11) with the latch 160 in essentially the same manner as the latch 60.

Each member 46A and 46B also has a front face 66A and 66B respectively that act substantially equivalent to the front face 66 as described above, cooperating with the latch 160 when in retracted position and with the rear face 68 of the mounting block 34 when in operative position.

The latch 160 is very similar to the latch 60 in that it has a latching section 162 similar to the section 62 and a flat spring section 164 that function in essentially the same manner as their corresponding sections, however the section 162 is formed so that it can cooperate and engage the front face 66A or 66B in the area between the pin 42A or 42C and the surface 32. The latching section 162 does not extend from the flat spring 164 as far as the latching section 62 did from its spring 64.

It will be apparent that the single pin members 46A and 46B are essentially identical and the abutment members are preferably sized so that the pin member may be spun on their longitudinal axes as indicated by the arrow 500 in FIG. 11 to orient the gripping pin to apply more or less pressure between the pin and the dome 52 without completely removing the pin member.

In the illustrated arrangement a single flat spring 164 and latching section 162 has been shown to accommodate both pin members 46A and 46B, it will be apparent that separated latching members for each pin member may be provided as desired.

Similarly, while the mounting blocks 34 have each been shown to accommodate a pair of gripping pins 42, 44, 42A, 42B, 44A and 44B by using a pair of passages 38 and 40 with the single pin members, the FIG. 11 to 13 embodiment of the mounting member could easily be modified to have only a single passage (bear in mind the dome has 2 sides so it would normally be simpler to make the mounting block 34 as described).

Figure 14:
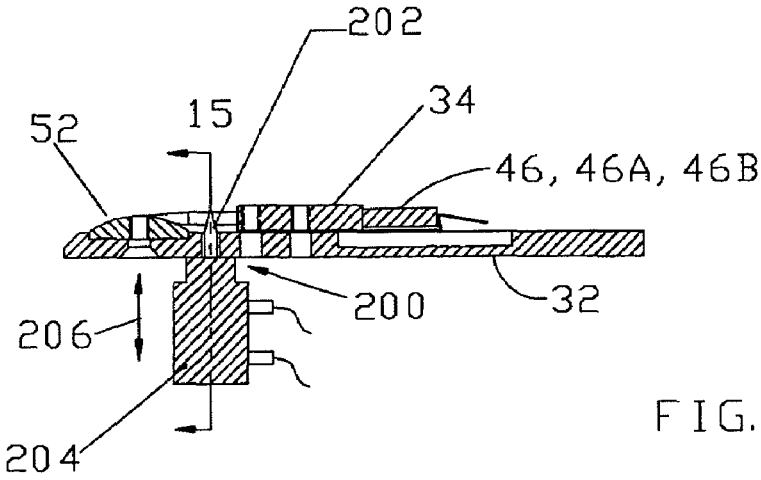
FIG. 14 is a section similar to FIG. 6 but with parts omitted showing another version of the present invention using a gripping member in the form of a gripping pin in operative gripping position.
Figure 15:
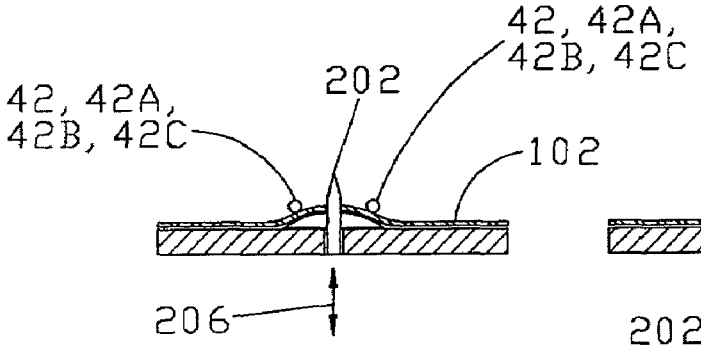
FIG. 15 is a section along the line 15-15 of FIG. 14.
Figure 16:
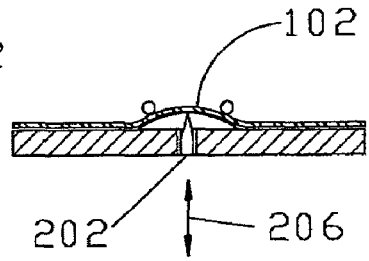
FIG. 16 is a view similar to FIG. 15 but showing the gripping pin in a retracted position.

Turning now to FIGS. 14, 15 and 16 the gripping system may be any of the above described systems using any the pin members as described above in combination with a holding block 34 and a dome 52, and for that matter could be the pin gripping system as described in the U.S. Pat. No. 4,553,954 discussed above. The important difference is the provision of a gripper means which includes a gripping element 202, which in this embodiment is in the form of an impaling pin that is movable by a solenoid or the like 204 as indicated by the arrow 204 between an impaling operative gripping position as shown in FIG. 15 with the impaling pin 202 extended to penetrate through at least one layer of the laminate from which the blank is made (in the illustrated arrangement through the layer 102) and a retracted position where the gripper 202 does not contact the laminate as shown in FIG. 16. It will be noted that the gripper 200 is preferably positioned midway between the two holding pins (when two holding pins such as 42 and 44 are provided in that position) i.e. in line with center of the dome 52 on a line parallel to the axes of the passages 38 and 40 so that the liner 102 is better trapped by the pin 202.

Figure 17:
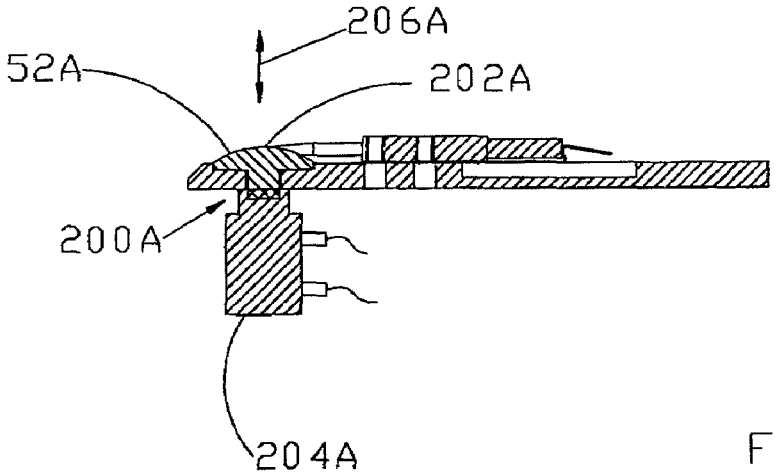
FIG. 17 is a section similar to FIG. 14 showing another version of the present invention using the dome as the gripping member and with the gripping member in operative gripping position.

In another embodiment employing a gripper means 200A as shown in FIG. 17 the dome 52A itself is moveable as indicated by the arrow 206A by a suitable solenoid or the like 204A and forms a gripping element 202A that cooperates with the holding pins to better grip the layer 102 there between. As with the impaling pin 202 the gripping element 202A is moveable from a retracted position wherein it functions as an ordinary dome, to an extended position wherein it increases the pressure between the pins and dome to better hold the laminate 102.

The timing of operation of the gripper 200 or 200A into operative position is controlled in any suitable manner but is not triggered until the laminate is fully in position on the holding pins.

This added gripper 200 or 200A better ensures that the blank does not move relative to the panel or jay 32 and is particularly useful when heavier laminates are used to form the case blank.

It will be apparent that if solenoids such as those shown at 204 and 204A are employed the mechanism for removing blanks at the front of the magazine (not shown) may require revision to accommodate these solenoids (or other mechanisms used to move the gripper). For example, the separator member that pushes the leading blank down into the injector that injects the blanks up between the jaws 12 and 14 in the pick-up position may have to be cut away to accommodate these solenoids.

Having described the invention, modifications will be evident to those skilled in the art without departing from the scope of the invention as defined in the appended claims.

We claim:

1. A method of operating a gripping system for equipment for handling panels formed by laminates having at least one surface ply, said method comprising:

mounting a mounting block on an operating panel of said equipment, the pin mounting block having a holding pin that terminates in a free end spaced from a surface of the operating panel;

positioning a gripping element in a release position spaced from said holding pin placing said surface ply between said holding pin and the gripping element; and moving said gripping element toward said holding pin into a gripping position impairing movement of said surface ply relative to said gripping element and said holding pin.

2. The method of claim 1, wherein said gripping element is a dome.

3. The method of claim 1, wherein said gripping element comprises an impaling pin having a longitudinal axis traversing said panel.

4. The method of claim 3 comprising impaling said surface ply when said impaling pin is in said gripping position.

5. A gripping system for equipment for handling panels formed by laminates having at least one surface ply, said gripping system comprising:

a pin mounting block on a surface of an operating panel of said equipment;

a pin member extending from the block and having a holding pin that terminates in a free end that is spaced from the surface of the operating panel;

a gripping element positioned relative to said mounting block so that when said pin member is in an operative position, said holding pin cooperates with said gripping element to grip said surface ply;

wherein said gripping element is moveable away from and back toward said holding pin between a gripping position impairing relative movement between said surface ply and said gripping element and a release position.

6. The gripping system of claim 5, wherein said gripping element is a dome and wherein said dome is moveable toward said holding pin to place said dome in said gripping position, and said dome is moveable away from said holding pin to place said dome in said release position.

7. The gripping system of claim 5, wherein said gripping element comprises an impaling pin having a longitudinal axis traversing said panel.

8. The gripping system of claim 7, wherein said impaling pin impales said surface ply when said impaling pin is in said gripping position.

9. A gripping system for equipment for handling panels formed by laminates having at least one surface ply, said gripping system comprising:

a pin mounting block on an operating panel of said equipment;

a pin member extending from the block and having a holding pin that terminates in a free end;

a dome positioned relative to said mounting block so that when said pin member is in operative position with said free end adjacent to said dome said holding pin adjacent said free end can cooperate with said dome to grip said surface ply therebetween;

gripper means positioned adjacent to said holding pin when said pin member is in said operative position, said gripper means having a gripping element; and means for moving said gripping element between a gripping position impairing relative movement between said surface ply and said pin member and a release position.

10. The gripping system of claim 9, wherein said gripping element comprises an impaling pin having a longitudinal axis traversing said panel and wherein said means for moving extends said impaling pin axially toward said holding pin to said gripping position.

11. The gripping system of claim 10, wherein said impaling pin impales said surface ply when said impaling pin is in said extended position.

* * * * *